United States Patent [19]

Scarton et al.

[11] 4,346,783

[45] Aug. 31, 1982

[54] APPARATUS FOR TREATING FLOWING WORKING GASES PARTICULARLY TO REDUCE THE NOISE IN OPERATION THEREOF

[75] Inventors: Henry A. Scarton, Troy, N.Y.; Warren C. Kennedy, Pittsburgh, Pa.; Keith R. Gaylo, Syosset, N.Y.; Clark R. Caplan, Natick, Mass.

[73] Assignee: Rensselaer Polytechnic Institute, Troy, N.Y.

[21] Appl. No.: 191,007

[22] Filed: Sep. 26, 1980

[51] Int. Cl.[3] ..... F01N 1/08

[52] U.S. Cl. ..... 181/230; 181/237; 181/239; 181/265; 181/272; 181/274

[58] Field of Search ..... 181/230, 231, 236, 237, 181/247, 254, 278, 281, 265, 272, 274, 239; 137/516.15, 516.11, 853, 855, 812

[56] References Cited

U.S. PATENT DOCUMENTS

| | | | |
|---|---|---|---|
| 3,179,124 | 4/1965 | Haring | 137/516.11 |
| 3,311,120 | 3/1967 | Palmisano | 137/812 |
| 3,815,705 | 6/1974 | Bennett | 181/230 |
| 3,894,611 | 7/1975 | Raudman, Jr. | 181/237 |
| 4,027,740 | 6/1977 | Martin | 181/281 |

*Primary Examiner*—Richard A. Wintercorn
*Assistant Examiner*—Benjamin R. Fuller
*Attorney, Agent, or Firm*—McGlew and Tuttle

[57] ABSTRACT

A device for treating flowing working gases in order to reduce their operational noises and in most instances also to increase their operating efficiency comprises a flowing working gas operating device which has a discharge conduit with at least one discharge opening for the outflow of the working gas. A check valve is associated with the discharge and includes an elastic valve member movable to close the opening when the flow thereof decreases to a predetermined amount for example as determined by the reduction of pressure of the gases so as to prevent any back flow into the conduit which is likely to produce noise. The elastic member may comprise an ordinary rubber band which is preferably held in position by a guide member so that when the pressure of the working gas is sufficient the gases will flow out of the discharge conduit and will be directed through one or more chambers so as to cause the gas to flow into a whirling vortex flow and preferably in a substantially annular path so as to order the gases and to thereby increase their efficiency of operation.

6 Claims, 6 Drawing Figures

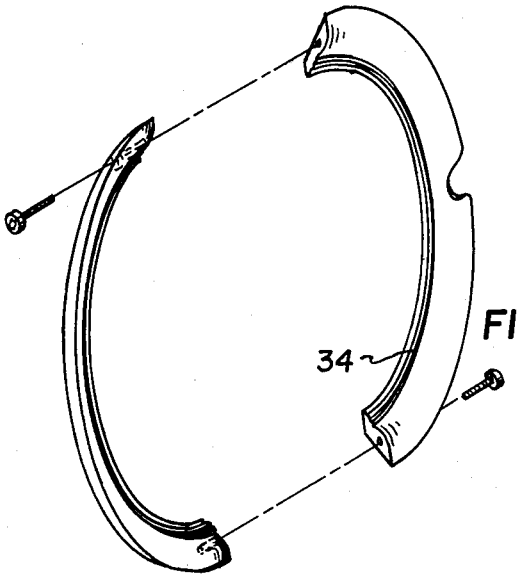
FIG. 3
FIG. 2
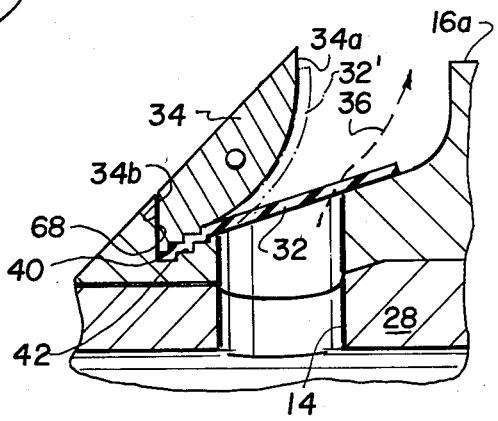
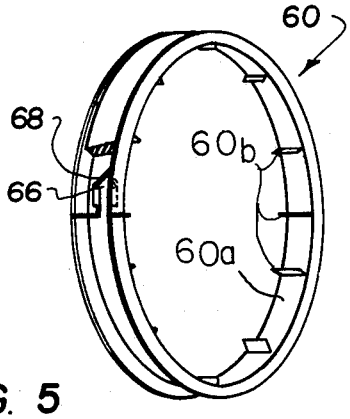
FIG. 5
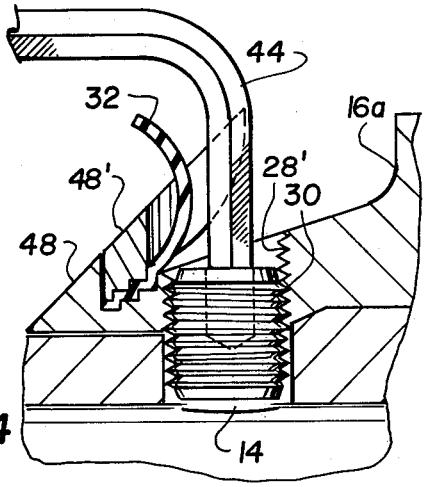
FIG. 4

APPARATUS FOR TREATING FLOWING WORKING GASES PARTICULARLY TO REDUCE THE NOISE IN OPERATION THEREOF

CROSS-REFERENCE TO RELATED PATENT APPLICATION

This invention is an improvement over that disclosed and claimed in U.S. Pat. No. 4,244,442 granted Jan. 13, 1981.

FIELD AND BACKGROUND OF THE INVENTION

This invention relates in general to an apparatus for treating flowing working gases and in particular to a new and useful device particularly for reducing the noise of operation of devices such as internal combustion engines, air operated tools, etc. and further to increase the flow efficiency of such devices.

The present invention is an improvement over that disclosed and claimed in the above mentioned patent primarily in respect to the construction in which a check valve is employed at the discharge of the working gases which is effective to prevent back flow into the operating device and thus reduce its noise and also in respect to the details of construction of such a check valve and to an improved method of operating a tool to prevent noise particularly during turnoff.

SUMMARY OF THE INVENTION

In accordance with the invention a device is provided for treating flowing working gases primarily to reduce the operative noise of such gases which comprises a flowing working gas operating device which has a discharge conduit with at least one discharge opening and which includes check means connected to the discharge opening including a valve member which is movable to close the opening when the flow of the working gas decreases to a predetermined amount thereby preventing back flow into the conduit. It has been found that by eliminating this back flow a material aspect of the operating noise of the devices, particularly air tools, is reduced. In addition it has also been found that an arrangement in which the gases which have performed work, for example at a tool or other device, are permitted to flow through a check valve and are ordered in directions so that they flow into a whirling vortex and then an annular flow, insures that the efficiency of the device will be increased because the gases do not provide resistances to flow which may be caused by the eddying or reversal of flow of such gases. By directing the gases through the discharge opening so that they flow into association with a wall which orients them into a whirling vortex flow and then moves through a substantially annular path, it has been determined that the gases will flow uniformly and evenly through the device and be discharged in the atmosphere with a minimum of operating noise and that the device's efficiency will be improved.

In accordance with a feature of the invention the apparatus includes a housing which may be constructed directly over an exhaust conduit for the operating device. The exhaust conduit advantageously is provided with a plurality of circumferenspaced discharge openings in a position in which they align with an annular member which may be closed by an elastic check valve member. A check valve member in the form of a rubber band is positioned over the annular member to overlie the openings and close them except when the gases are flowing with sufficient pressure to cause the elastic check valve member to raise upwardly and open the discharge openings.

The construction of the device is improved by the provision of a guide ring which is mounted so that a lower step portion thereof is locked over a step portion of the annular member and holds the elastic member along one edge thereof so that it is in a good position to regulate the flow through the openings of the discharge conduit. The ring member is advantageously made of two parts which may be easily assembled to the annular member having the openings by bolt elements which secure the two ring parts together in position. The ring member acts on the elastic valve member to hold it at its one annular edge in a manner to permit its opposite edge to lift upwardly and permit the outflow of the gases through the openings. The openings of the annular member are aligned easily with the openings of the discharge conduit preferably by a construction in which the annular member is provided with at least one threaded hole through which a plug member is threaded so that it engaged in one of the openings of the exhaust and aligns the remaining openings with the remaining openings of the exhaust conduit.

The ring member which overlies the elastic valve member has a curved surface facing the valve member against which the elastic valve member may be pressed by the flowing gases and which is shaped to direct the gases in an even flow against a wall of a first annular vortex chamber. The gases by their normal characteristics of adhering to the wall and by the shape of the wall of the chamber will be directed into a whirling vortex flow. The chamber is advantageously made annular so that the whirling vortex flow will be maintained in a toroidal form. This flow stabilizes the gases and permits a small quantity thereof to move outwardly of the first chamber and pass through a constricted passage to one or more second chambers. The last chamber in alignment is advantageously provided with a discharge directly into the atmosphere. Valve means may also be associated with this latter discharge or may be used at this location rather than being positioned directly at the exhaust openings of the working fluid operating device.

In accordance with another embodiment of the invention the check valve employed for controlling the gases out of the operating device includes a ring member which is designed to permit expansion and contraction of its diameter and it defines an annular receiving recess for a resilient band member forming a valve. The band member holds the ring parts together in a position in which they are seated over the openings of the annular member which is connected to the exhaust conduit openings. Increases of pressure produced by the outflow of the working gases cause the ring member to expand and to permit the outflow of the gases in a manner similar to the other embodiment.

Accordingly it is an object of the invention to provide a device for treating flowing working gases so as to reduce the noise of operation of such gases which comprises a flowing working gas operating device having a discharge conduit with at least one discharge opening for the outflow of the working gas and a check valve connected to the discharge opening including a valve member movable to close the opening when the flow thereof decreases to a predetermined amount and to prevent any back flow of the gas into the conduit.

A further object of the invention is to provide a device for treating flowing working gases which includes a housing connected to a conduit for the discharge of these gases in a position overlying a discharge opening and which includes a check valve for preventing flow backward through the opening and means for directing the gases after they pass out of the opening into a whirling vortex flow and then into an annular flow and for discharge to the atmosphere.

A further object of the invention is to provide a method for substantially reducing operating noise of the operation of a flowing fluid operating device such as a tool, a power engine, etc. which comprises directing the gas through a conduit and out through at least one discharge opening of the conduit, enclosing the opening whenever the gas flow is reduced by a predetermined amount so as to prevent back flow into the conduit.

A further object of the invention is to provide a device for treating flowing gases which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the Drawings:

FIG. 2 is an enlarged partial sectional view of a portion of the device shown in FIG. 1;

FIG. 3 is a perspective view indicating the interconnection of the parts of the ring member holding the check valve of FIG. 2;

FIG. 4 is a view similar to FIG. 2 showing the check valve in an open position and indicating the interconnection of the check valve to the annular support member;

FIG. 5 is a perspective view partly in section of another embodiment of the check valve.

DETAILED DESCRIPTION OF PREFERRED EMBODIMENTS

Figure 1:
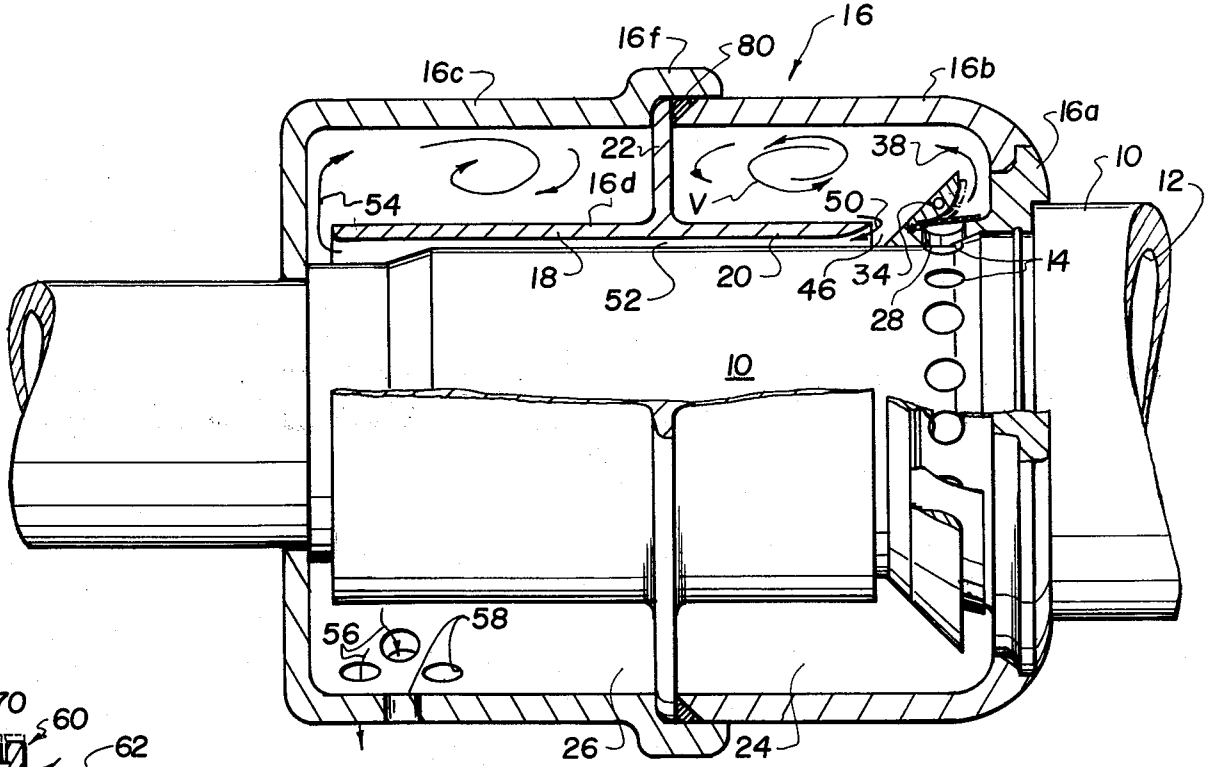
FIG. 1 is a partial axial sectional view of a device for reducing the operating noise of a working gas and for increasing the efficiency of the operating device constructed in accordance with the invention.

Referring to the drawings in particular the invention embodied therein comprises a device for treating flowing working gases which in the embodiment shown comprises a discharge conduit 10 of an air driven tool. The discharge conduit 10 conducts a working fluid through a central passage 12 and out through a plurality of circumferentially spaced openings 14.

In accordance with the invention there is provided an operating device for treating the flowing working gases comprising a housing generally designated 16 which includes an annular housing collar portion **16*a* which engages tightly over the conduit 10, an annular end housing portion 16*b*, an annular second end housing portion 16*c* and a housing dividing portion 16*d*. The dividing member or housing portion 16*d* includes axially extending housing parts 18 and 20 and a radially extending housing part 22. The interior of the housing is divided into a first annular chamber 24 and preferably one or more additional annular flow chambers which in this embodiment comprises a single annular chamber 26**.

In accordance with another feature of the invention the housing collar part **16*a* includes an annular portion which overlies the conduit 10 at a location having the openings 14 and it also has a plurality of openings 28 which align with the openings 14 and permit flow of the working gases therethrough. As shown in FIG. 4, the annular housing part 16*a* includes at least one threaded bore 28' into which a plug member 30 is inserted so as to align this bore 28' with a single one of the openings 14** and thus in effect cause alignment of all of the bores.

In accordance with another feature of the invention check valve means in the form of an elastic valve member 32 which is held in position by an annular ring member 34 is opened by the flow of the working gases so that it assumes a dot-dash line position during full flow operation in which it becomes deflected into engagement with a curved surface **34*a* of the ring member and permits a flow of the gases in the direction of arrows 36 into a first annular flow chamber 24. The gases which move in the directions indicated in FIG. 2 move further in the direction indicated by arrow 38 in FIG. 1** so that they are formed into a whirling vortex V. The gases are then oriented so that they move in a whirling toroidal vortex flow. This has the effect of ordering the gas flow and increasing the flow efficiency and preventing frictional disturbances such as eddys which would slow down the gases and cause less efficiency and increased noise.

A feature of the construction of the ring 34 is that it has a positioning edge **34*b* which permits it to be oriented alongside an edge 68 of the housing part 16*a*. In addition the lower edge of the ring 34 is provided with steps 40 which align over similar steps 42 in a recess of the housing part 16*a*. The valve member 32 is disposed between the ring member 34 and the housing part 16*a* at the location of the steps 40 and 42 so that the whole annular edge of this valve member is held in a stationary position which permits the opening of the valve by the flapping of it into the position for example indicated in dot-dash lines 32' in FIG. 2. Also to insert the plug 30 an Allen wrench 44 may be inserted into the plug 30 to position it by lifting the valve 32 as shown in FIG. 4**.

After the gases are initially stabilized in the first annular chamber 24 they may be advantageously moved through a small sized opening 46 which is defined between the dividing housing part **16*d* and the collar portion 16*a*. Both the ring 34 and the collar housing part 16*a* define an oblique face 48 and 48' to provide a smooth transition surface for the whirling vortex flow of gases to permit some of them to move in the direction of an arrow 50 back through a constricted passage 52 defined between the axial housing parts 18 and 20 and the conduit 10 and then to flow in the direction of an arrow 54 into the second annular flow chamber 26**.

In the chambers 26 a second whirling vortex annular flow and the continually ordered gases are then permitted to exit in the direction of arrow 56 through one or more openings 58 which lead to atmosphere.

The housing 16 may be easily assembled over the tool discharge conduit and the housing dividing portion **16*d* is easily assembled with the end portions 16*b* and 16*c* as indicated by connecting them together in any suitable manner with the use of the lip 16*f* which overlies the central radial housing part 22. A seal 80** may be disposed between the mating housing parts.

It has been found with the invention that operating noises of a device particularly an air tool will be greatly reduced by the mere provision of the check valve means to insure that there is no back flow into the device once it is shut down. In addition it has been found that by permitting the gases to exit from the check valve in an orderly flow and to orient them in a whirling vortex flow that the discharge of the gases becomes ordered and more efficient and does not interfere with the operating efficiency of the device during its continuing operation.

Figure 6:
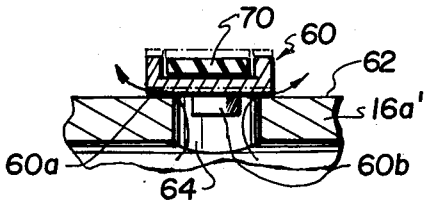
FIG. 6 is an enlarged sectional view similar to FIG. 2 of the embodiment of the device shown in FIG. 5.

The check valve means may also include a device as shown in FIG. 5 and 6. In this embodiment an expandible ring member generally designated 60 shaped to engage on a flat surface 62 of a housing collar portion 16*a'* which is similar to the housing collar portion 16*a* of the other embodiments. The housing collar portion 16*a'* is an annular and is provided with a plurality of openings 64 at spaced circumferential locations around its periphery similar to the other embodiment. The ring member 60 has a bottom surface 60*a* with a plurality of projections 60*b* which extend into the opening 64 and align the ring member 60 over the housing collar portion 16*a'*. The ring member 60 is constructed so that it may expand circumferentially and thus lift off the openings 64 to open them for the passage of a gas therethrough. The expansion of the ring member 60 is effected by means of a coupling portion 66 which engages in a slot 68 which permits expansion and retraction of the ring during operation.

The ring 60 in conjunction with an elastic member or rubber band 70 holds the openings 64 closed until the gases achieve a predetermined pressure in which case they flow out of the openings when the member 60 rises off the surface 62 after it overcomes the holding pressure of the band 70.

It has been found that both the valve construction of the embodiment of FIGS. 1 to 4 and the valve construction of FIGS. 5 and 6 make it possible for the air to exit from a working device such as an air operated tool during the operation of the tool but they insure that the air will not flow backwardly into the tool and cause a loud turnoff noise. In addition the valve permits the flow of the air out of the tool into the whirling vortex flow which permits an ordered discharge of the air from the tool and in fact orders the flow of the air in the tool to the extent that the efficiency of operation is increased.

In addition this ordering of the air or other gas insures that the operating noise will be materially reduced.

While specific embodiments of the invention have been shown and described in detail to illustrate the application of the principles of the invention, it will be understood that the invention may be embodied otherwise without departing from such principles.

What is claimed is:

1. An apparatus for treating flowing working gases flowing from a gas operating device having a discharge conduit with at least one discharge opening for the outflow of the working gases comprising:

a housing connected around the discharge conduit and over the discharge opening defining a first and at least one other annular flow chamber around the conduit;

a dividing member in said housing for dividing said first and other annular flow chambers from each other, and defining a constricted flow passage between said first and other chambers;

an elastic valve member overlying the discharge opening and being flexible outwardly of the opening by the pressure of the working gases;

a ring member having a curved surface facing said valve member extending from the conduit toward said housing adjacent one end of said first chamber near the discharge opening, and spaced from said housing to define an inlet to said first chamber, said valve member being flexible outwardly against said curved surface by an outflow of working gases through the discharge opening;

said ring member forming an oblique face facing said first chamber and spaced from an edge of said dividing member to form an inlet to said constricted flow passage, whereby a toroidal annular vortex flow is formed by working gases in said first chamber and, with a sudden reduction of pressure of said working gases, said elastic valve member closes the discharge opening to prevent a flow of gases from said first chamber into the conduit.

2. An apparatus according to claim 1, wherein the gas operating device includes a plurality of circumferentially spaced discharge openings around the conduit, an annular member connected around the conduit and over the discharge openings having a plurality of bores therethrough aligned with the discharge openings, said annular member including a collar portion forming a part of said housing adjacent the discharge openings, said annular member having a recess and said ring member connected at a radially inner edge thereof to said annular member recess with said elastic valve member connected therebetween at one annular edge of said elastic valve member.

3. An apparatus according to claim 2, wherein one of said annular member bores is threaded and a set screw threaded into said threaded annular bore and extending into an associated one of the discharge openings for aligning said plurality of bores with the plurality of discharge openings.

4. An apparatus according to claim 2, including steps formed in said recess and corresponding steps formed on said ring member for holding said elastic valve member therebetween.

5. An apparatus according to claim 2, wherein said annular member has an oblique face projecting from said ring member oblique face to the conduit and adjacent said constricted flow passage inlet.

6. An apparatus for treating flowing working gases flowing from a gas operating device having a discharge conduit with a plurality of annularly distributed discharge openings for the outflow of the working gases comprising:

a housing connected around the discharge conduit and over the discharge openings defining a first and at least one other annular flow chamber around the conduit;

a dividing member in said housing for dividing said first and other annular flow chambers from each other, and defining a constricted flow passage between said first and other chambers;

an annular resilient valve member overlaying all of the discharge openings and being flexible outwardly of the openings by the pressure of the working gases, said valve member comprising an expandable split ring and an elastic band overlaying said ring, said ring including downwardly extending projections in spaced circumferential locations around its interior which engage into respective ones of the openings;

said openings and overlaying valve member positioned between a wall of said housing adjacent the conduit and an inlet from said first annular flow chamber to said constricted flow passage formed by an edge of said dividing member;

said ring, when flexed outwardly into a position spaced from said openings, defining an inlet to said first chamber;

the space between said ring in its spaced position and the conduit being adjacent said edge of said dividing member which forms the inlet to said constricted flow passage, whereby a toroidal annular vortex flow is formed by working gases in said first chamber and, with a sudden reduction of pressure of said working gases, said valve member closes the discharge openings to prevent a flow of gases from said first chamber into the conduit.

* * * * *